US009299309B2

(12) United States Patent
Tseng et al.

(10) Patent No.: US 9,299,309 B2
(45) Date of Patent: Mar. 29, 2016

(54) INTEGRATED SOURCE DRIVER AND LIQUID CRYSTAL DISPLAY DEVICE USING THE SAME

(71) Applicant: NOVATEK Microelectronics Corp., Hsin-Chu (TW)

(72) Inventors: Po-Yu Tseng, Taoyuan County (TW); Chia-Wei Su, Hsinchu (TW); Po-Hsiang Fang, Hsinchu (TW); Shun-Hsun Yang, Hsinchu (TW); Hsin-Hung Lee, Kaohsiung (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 371 days.

(21) Appl. No.: 13/957,440

(22) Filed: Aug. 2, 2013

(65) Prior Publication Data

US 2014/0132587 A1 May 15, 2014

(30) Foreign Application Priority Data

Nov. 13, 2012 (TW) ..... 101142202 A

(51) Int. Cl.
*G09G 3/36* (2006.01)

(52) U.S. Cl.
CPC ..... *G09G 3/3696* (2013.01); *G09G 3/3614* (2013.01); *G09G 3/3688* (2013.01); *G09G 2320/0673* (2013.01)

(58) Field of Classification Search
CPC . G09G 3/3696; G09G 3/3614; G09G 3/3688; G09G 2320/0673
See application file for complete search history.

(56) References Cited

U.S. PATENT DOCUMENTS

| | | | | |
|---|---|---|---|---|
| 8,059,115 | B2 * | 11/2011 | Matsuki | G09G 3/3611 345/212 |
| 2001/0052897 | A1 * | 12/2001 | Nakano | G09G 3/2011 345/204 |
| 2003/0085865 | A1 | 5/2003 | Lee | |
| 2007/0126686 | A1 | 6/2007 | Chang | |
| 2010/0033514 | A1 | 2/2010 | Park | |

FOREIGN PATENT DOCUMENTS

| | | | |
|---|---|---|---|
| CN | 1335588 | A | 2/2002 |
| CN | 1417769 | A | 5/2003 |
| CN | 101645232 | A | 2/2010 |
| EP | 2 230 663 | A1 | 9/2010 |
| TW | 200521953 | | 7/2005 |
| TW | 200633397 | | 9/2006 |
| TW | 200710784 | | 3/2007 |
| TW | 200802247 | | 1/2008 |
| TW | 201128600 | | 8/2011 |

* cited by examiner

*Primary Examiner* — Andrew Sasinowski
(74) *Attorney, Agent, or Firm* — Winston Hsu; Scott Margo

(57) ABSTRACT

The present invention discloses an integrated source driver for a liquid crystal display device. The integrated source driver includes a reference voltage generating circuit, for providing a plurality of adjustable voltage ranges within a supply voltage and a ground level, and a reference voltage selecting circuit, including a plurality of digital to analog converters, for selecting and generating a plurality of internal reference voltages from the plurality of adjustable voltage ranges, respectively. The plurality of adjustable voltage ranges decrease progressively.

16 Claims, 14 Drawing Sheets

INTEGRATED SOURCE DRIVER AND LIQUID CRYSTAL DISPLAY DEVICE USING THE SAME

BACKGROUND OF THE INVENTION

1. Field of the Invention

The present invention relates to an integrated source driver and a liquid crystal display device thereof, and more particularly, to an integrated source driver and a liquid crystal display device thereof capable of integrating an external reference voltage generator and limiting generated adjustable voltage ranges of each internal reference voltage, to save hardware cost or increase voltage adjustment resolution.

2. Description of the Prior Art

Owing to the low price and high quality, liquid crystal display devices have been widely used in information products such as notebooks, Personal Digital Assistants (PDAs), Mobile phones, and watches.

A liquid crystal display device is mainly composed of single or a plurality of source drivers, single or a plurality of gate drivers and a panel. The source drivers and the gate drivers are used for controlling crisscrossing data lines and scan lines in the panel, and a thin film transistor is connected to intersections of each data line and scan line (i.e. the thin film transistors are distributed as a matrix on the panel, and each thin film transistor corresponds to a pixel). A conventional source driver needs to receive multiple external reference voltages to output a correct voltage to a data line, so as to drive a pixel of a panel of a liquid crystal display device for displaying. Therefore, reference voltages play important parts. In many applications, an additional reference voltage generator is utilized to strengthen the driving capability of the reference voltages and stabilize the reference voltages.

Besides, in a conventional panel application, the output voltages of the source drivers are changed by adjusting reference voltages, so as to adjust a screen color. Therefore, the reference voltage generator providing reference voltages to source drivers needs to be capable of adjusting to the reference voltages.

Please refer to FIG. 1, which is a schematic diagram of a conventional source driver 10 receiving positive gamma reference voltages $VPR_1$-$VPR_m$ and negative gamma reference voltages $VNR_1$-$VNR_m$ from an external reference voltage generator 12. As shown in FIG. 1, after the conventional source driver 10 receives positive gamma reference voltages $VPR_1$-$VPR_m$ and negative gamma reference voltages $VNR_1$-$VNR_m$ from the external reference voltage generator 12 and then the positive gamma reference voltages $VPR_1$-$VPR_m$ and the negative gamma reference voltages $VNR_1$-$VNR_m$ are processed by a positive polarity gamma correction resistor 102 and a negative polarity gamma correction resistor 104, the conventional source driver 10 outputs correct voltages to data lines for driving corresponding pixels by a digital to analog converter (DAC) and related circuits. This part is well-known for those skilled in the art, and hence is not narrated hereinafter.

In such a situation, to save a system cost and dynamically adjust reference voltages, the external reference voltage generator 12 and the conventional source driver 10 are further integrated into an integrated source driver in the prior art, such that multiple reference voltages are generated inside the integrated source driver by a single controlling method.

Noticeably, in order to adapt to different applications, each reference voltage outputted by the conventional external reference voltage generator 12 needs to be adjustable by a controlling mechanism, and the conventional external reference voltage generator 12 needs to provide rail-to-rail adjustable ranges (i.e. each reference voltage is adjustable within a supply voltage and a ground level of the external reference voltage generator 12).

However, if the conventional external reference voltage generator 12 and the conventional source driver 10 are directly integrated into the integrated source driver, and if the adjustable ranges of the reference voltages are still the same with the rail-to-rail adjustable ranges of the conventional external reference voltage generator 12 while high resolution is maintained, the hardware cost is quite large because the source driver 10 requires more reference voltages. Thus, there is a need for improvement of the prior art.

SUMMARY OF THE INVENTION

It is therefore an objective of the present invention to provide an integrated source driver and a liquid crystal display device thereof capable of integrating external reference voltage devices and limiting generated adjustable voltage ranges of each internal reference voltage, to save hardware cost or increase voltage adjustment resolution.

The present invention discloses an integrated source driver for a liquid crystal display device. The integrated source driver comprises a reference voltage generating circuit, for providing a plurality of adjustable voltage ranges within a supply voltage and a ground level; and a reference voltage selecting circuit, comprising a plurality of digital to analog converters (DACs), for selecting and generating a plurality of internal reference voltages from the plurality of adjustable voltage ranges according to a control signal, respectively; wherein the plurality of adjustable voltage ranges decrease progressively.

The present invention further discloses a liquid crystal display device, comprising a plurality of data lines; and a plurality of integrated source drivers, for driving pixels of corresponding data lines in the plurality of data lines, respectively. A first integrated source driver in the plurality of integrated source drivers comprises a reference voltage generating circuit, for providing a plurality of adjustable voltage ranges within a power supply voltage and a ground level; and a reference voltage selecting circuit, comprising a plurality of digital to analog converters (DACs), for selecting and generating a plurality of first internal reference voltages from the plurality of adjustable voltage ranges according to a control signal, respectively; wherein the plurality of adjustable voltage ranges decrease progressively.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
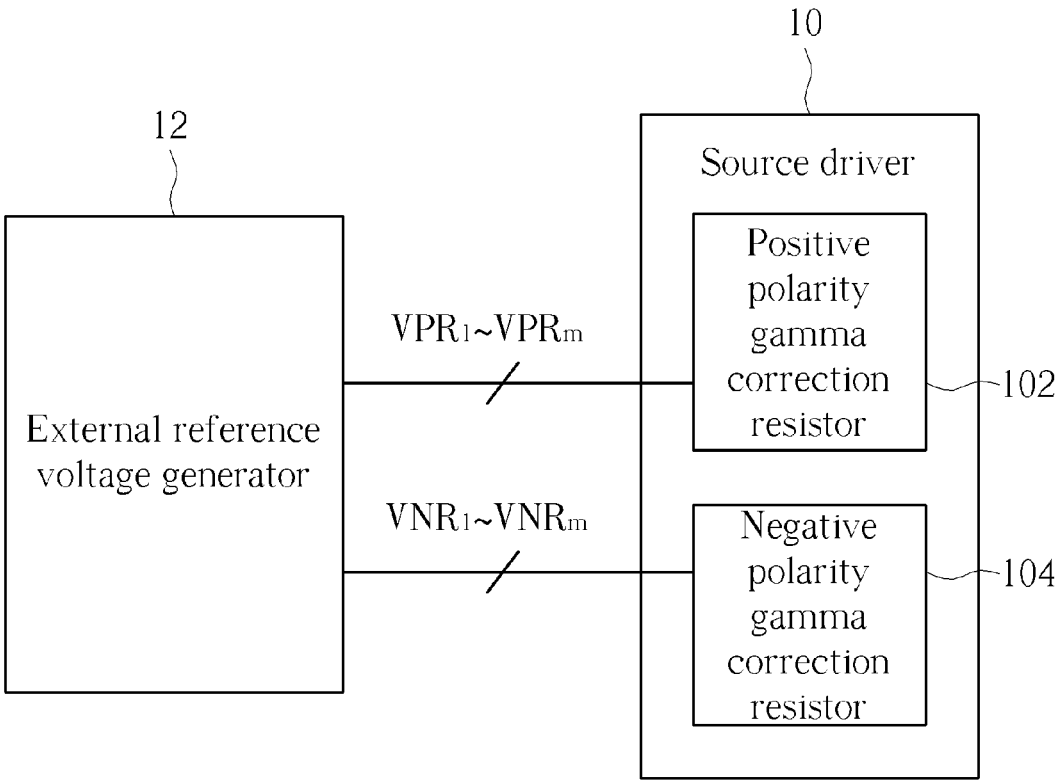
FIG. 1 PRIOR ART
FIG. 1 is a schematic diagram of a conventional source driver receiving positive gamma reference voltages and negative gamma reference voltages from an external reference voltage generator.
Figure 2:
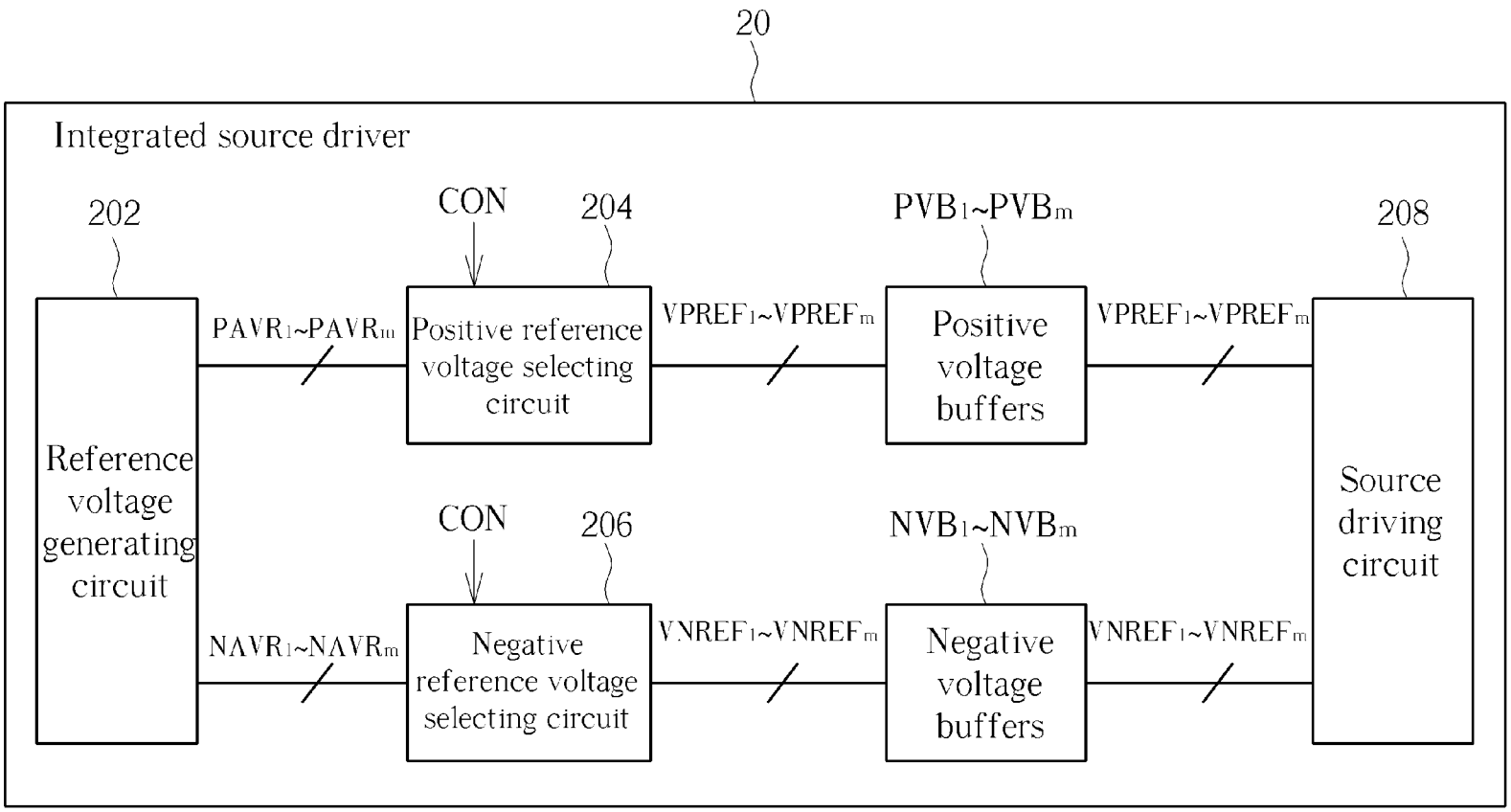
FIG. 2 is a schematic diagram of an integrated source driver according to an embodiment of the present invention.

Please refer to FIG. 2, which is a schematic diagram of an integrated source driver 20 according to an embodiment of the present invention. As shown in FIG. 2, the integrated source driver 20 includes a reference voltage generating circuit 202, a positive reference voltage selecting circuit 204, a negative reference voltage selecting circuit 206, positive voltage buffers $PVB_1$-$PVB_m$, negative voltage buffers $NVB_1$-$NVB_m$ and a source driving circuit 208.

In short, the reference voltage generating circuit 202 provides positive adjustable voltage ranges $PAVR_1$-$PAVR_m$ and negative adjustable voltage ranges $NAVR_1$-$NAVR_m$ within a supply voltage VS and a ground level GND for the reference voltage selecting circuit 204 and 206. The reference voltage selecting circuit 204 and 206 includes digital to analog converters (DACs) $PDAC_1$-$PDAC_m$, $NDAC_1$-$NDAC_m$ (not shown in FIG. 2), for selecting and generating internal reference voltages $VPREF_1$-$VPREF_m$, $VNREF_1$-$VNREF_m$ within the adjustable voltage ranges $PAVR_1$-$PAVR_m$, $NAVR_1$-$NAVR_m$ for the voltage buffers $PVB_1$-$PVB_m$, $NVB_1$-$NVB_m$ according to a digital control signal CON, respectively. The voltage buffer $PVB_1$-$PVB_m$, $NVB_1$-$NVB_m$ maintains voltage levels to stably output the internal reference voltages $VPREF_1$-$VPREF_m$, $VNREF_1$-$VNREF_m$ for source driving circuit 208 after buffering the internal reference voltages $VPREF_1$-$VPREF_m$, $VNREF_1$-$VNREF_m$, such that the source driving circuit 208 performs driving according to the internal reference voltage $VPREF_1$-$VPREF_m$, $VNREF_1$-$VNREF_m$. The adjustable voltage ranges $PAVR_1$-$PAVR_m$, $NAVR_1$-$NAVR_m$ decrease progressively (i.e. the internal reference voltages $VPREF_1$-$VPREF_m$, $VNREF_1$-$VNREF_m$ decrease progressively), and a structure and an operating of the source driving circuit 208 are similar to those of the conventional source driver 10.

In such a situation, since the adjustable voltage ranges $PAVR_1$-$PAVR_m$, $NAVR_1$-$NAVR_m$ distribute within the supply voltage VS and the ground level GND in a decreasing manner, the corresponding digital to analog converters $PDAC_1$-$PDAC_m$, $NDAC_1$-$NDAC_m$ adjust the internal reference voltages $VPREF_1$-$VPREF_m$, $VNREF_1$-$VNREF_m$ within each adjustable voltage ranges $PAVR_1$-$PAVR_m$, $NAVR_1$-$NAVR_m$ instead of within the supply voltage VS and the ground level GND. As a result, since adjustable ranges of the internal reference voltage $VPREF_1$-$VPREF_m$, $VNREF_1$-$VNREF_m$ are smaller in the integrated source driver 20, the present invention saves the hardware cost for the same voltage adjustment resolution, or increases the voltage adjustment resolution for the same hardware cost.

Figure 3:
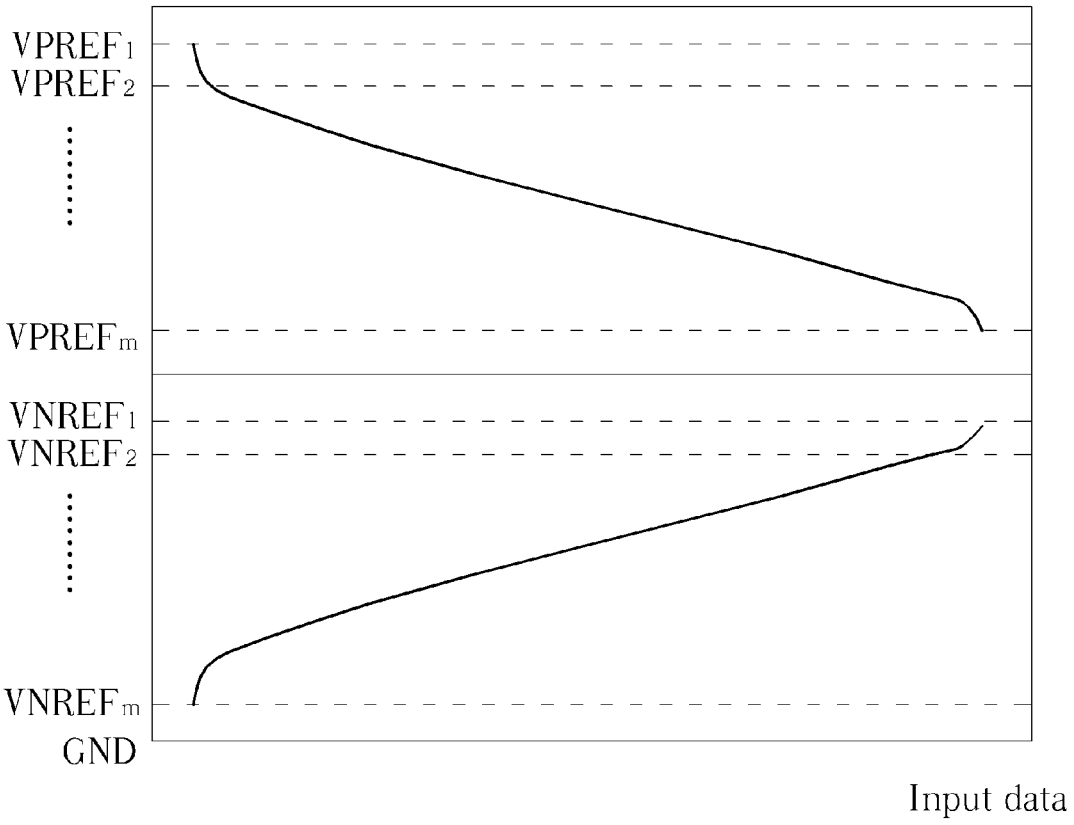
FIG. 3 is a diagram of an output voltage curve.
Figure 4:
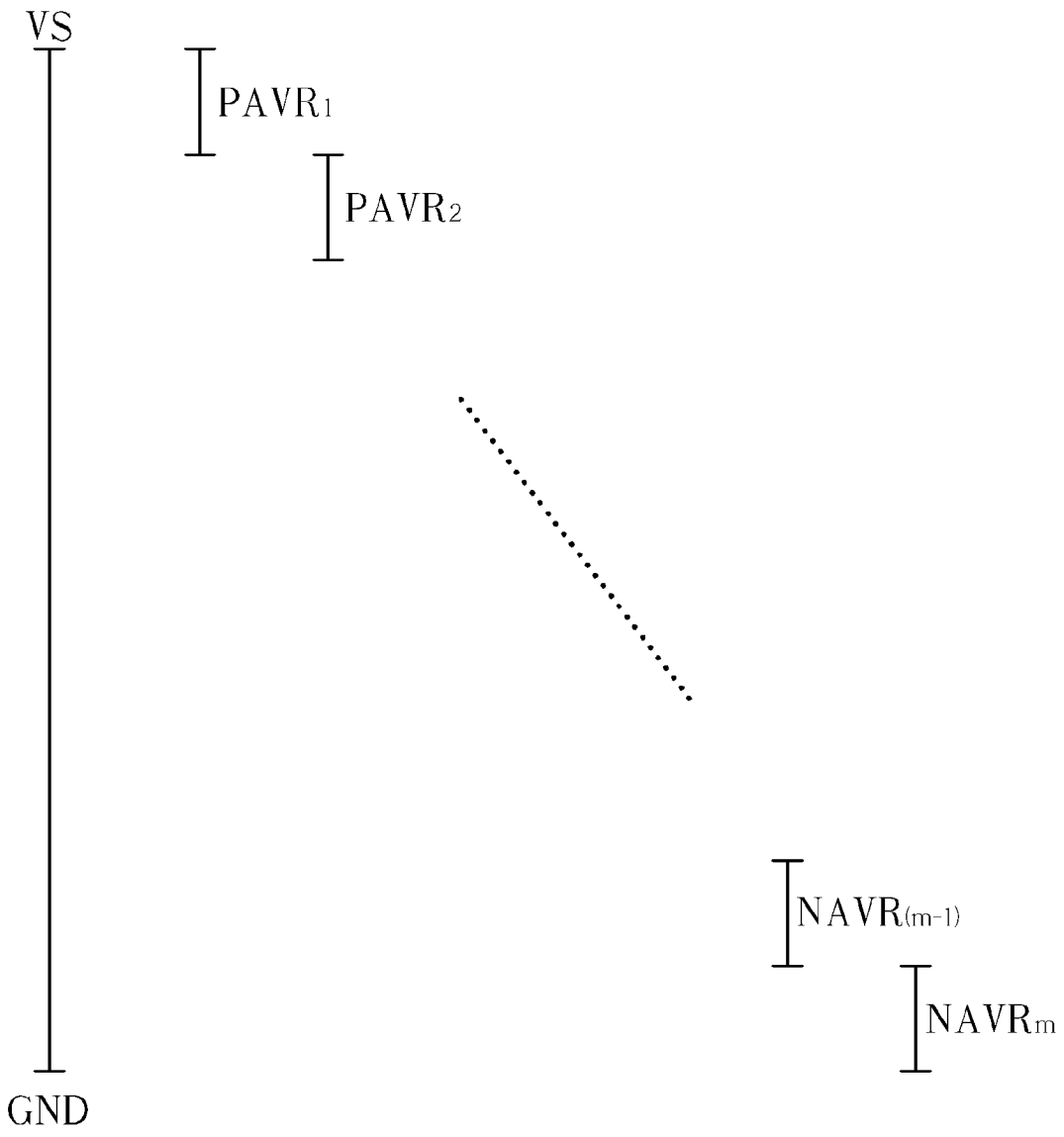
FIG. 4 is a diagram of adjustable voltage ranges shown in FIG. 2.

In detail, please refer to FIGS. 3 and 4. FIG. 3 is a schematic diagram of an output voltage curve. FIG. 4 is a schematic diagram of adjustable voltage ranges $PAVR_1$-$PAVR_m$, $NAVR_1$-$NAVR_m$ shown in FIG. 2. As shown in FIG. 3, the internal reference voltages $VPREF_1$-$VPREF_m$, $VNREF_1$-$VNREF_m$ employed in the panel application are corresponding to respective input data in the output voltage curve (i.e. a gamma curve). Since the internal reference voltages $VPREF_1$-$VPREF_m$, $VNREF_1$-$VNREF_m$ required by the source driving circuit 208 is divided into positive and negative polarities and decrease progressively from positive to negative (or increase progressively from negative to positive), the adjustable ranges of the internal reference voltages $VPREF_1$-$VPREF_m$, $VNREF_1$-$VNREF_m$ are not required to be rail-to-rail as those in the conventional external reference voltage generator 12 (i.e. all adjustable within the supply voltage VS and the ground level GND) when the integrated source driver 20 generates the internal reference voltages $VPREF_1$-$VPREF_m$, $VNREF_1$-$VNREF_m$ inside via integration. A maximum and a minimum values of the adjustable voltage ranges $PAVR_1$-$PAVR_m$, $NAVR_1$-$NAVR_m$ of the internal reference voltages $VPREF_1$-$VPREF_m$, $VNREF_1$-$VNREF_m$ can be optimized—according to a gamma curve in practical applications.

Specifically, as shown in FIG. 4, since the internal reference voltages $VPREF_1$-$VPREF_m$, $VNREF_1$-$VNREF_m$ decrease progressively, the adjustable voltage ranges $PAVR_1$-$PAVR_m$, $NAVR_1$-$NAVR_m$ in the integrated source driver 20 are designed to be minimized to specific ranges distributed within the supply voltage VS and the ground level GND, respectively. Noticeably, although the adjustable voltage ranges $PAVR_1$-$PAVR_m$, $NAVR_1$-$NAVR_m$ shown in FIG. 4 do not overlap with each other, the adjustable voltage ranges $PAVR_1$-$PAVR_m$, $NAVR_1$-$NAVR_m$ may partially overlap with each other according to different panel applications in other embodiments. As a result, since the adjustable voltage ranges $PAVR_1$-$PAVR_m$, $NAVR_1$-$NAVR_m$ are smaller than the rail-to-rail adjustable ranges within the supply voltage VS and the ground level GND, the present invention can save the hardware cost for the same voltage adjustment resolution or increase the voltage adjustment resolution for the same hardware cost.

For example, since the adjustable range of each reference voltage in the conventional external reference voltage generator 12 is rail-to-rail, assume that the supply voltage VS is 16V, if a 10-bit digital to analog converter is utilized, the adjustment resolution of each level is 16V/1024=15.6 mV. In comparison, the integrated source driver 20 in the present invention is capable of limiting each adjustable voltage range of the adjustable voltage ranges $PAVR_1$-$PAVR_m$, $NAVR_1$-$NAVR_m$ to 2V based on practical applications. In such a condition, in one embodiment, the present invention can design each digital to analog converter in the reference voltage selecting circuit 204, 206 to be 7-bit for an adjustment resolution of 2V/128=15.6 mV for each level, and thus saves the hardware cost. In another embodiment, the present invention can design each digital to analog converter in the reference voltage selecting circuit 204, 206 to be 10-bit for an adjustment resolution of 2V/1024<2 mV for each level, and thus increases the voltage adjustment resolution. As a result, the present invention can generate the smaller adjustable voltage ranges $PAVR_1$-$PAVR_m$, $NAVR_1$-$NAVR_m$ of the internal reference voltage $VPREF_1$-$VPREF_m$, $VNREF_1$-$VNREF_m$ in the integrated source driver 20 according to practical applications, and therefore, achieves higher adjustable resolution for the same hardware cost or requires less hardware for the same resolution compared to the conventional external reference voltage generator 12.

Figure 5:
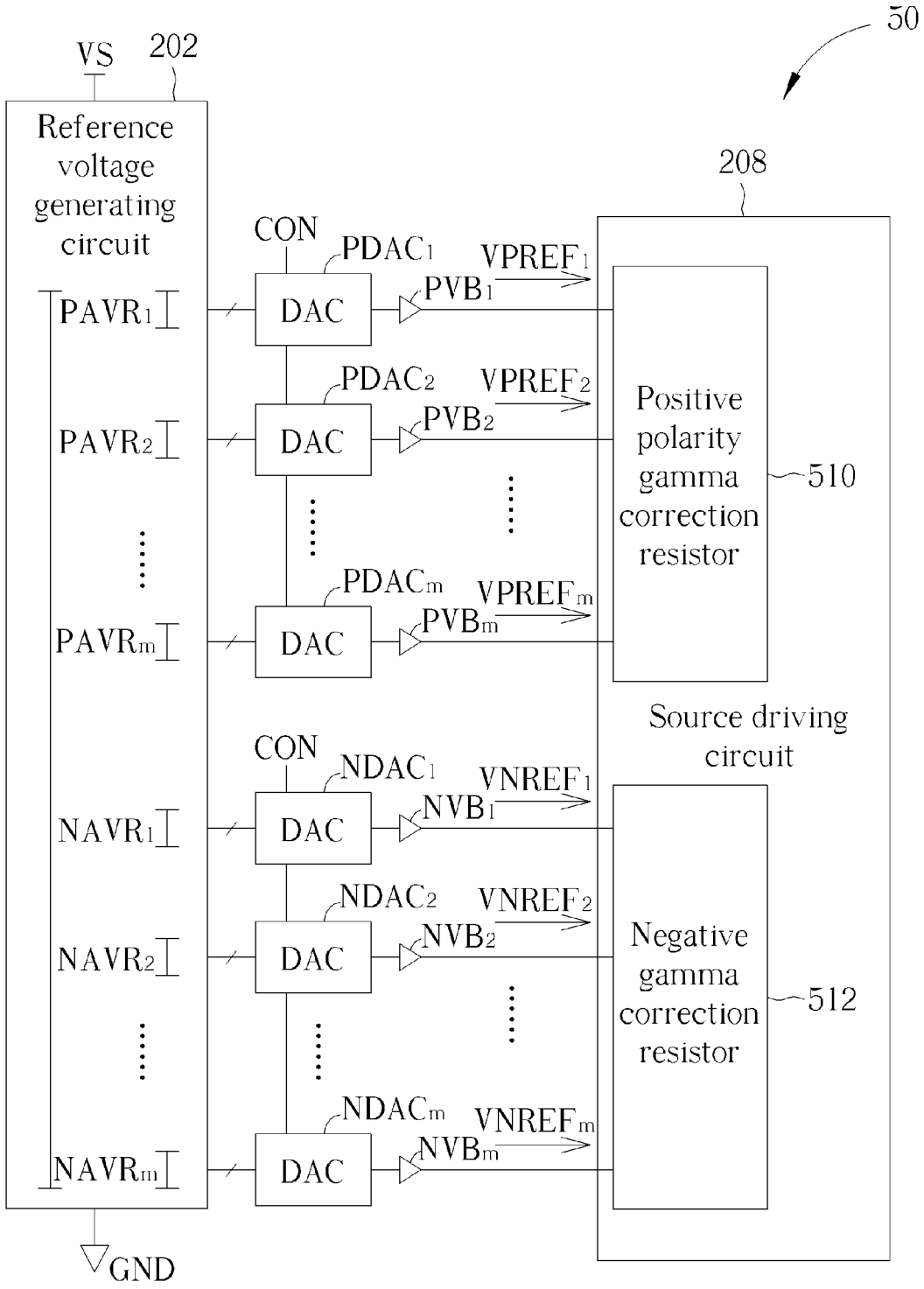
FIG. 5 is a schematic diagram of an integrated source driver for realizing the integrated source driver shown in FIG. 2.

Specifically, please refer to FIG. 5, which is a schematic diagram of an integrated source driver 50 for realizing the integrated source driver 20 shown in FIG. 2. As shown in FIG. 5, the integrated source driver 50 is a detailed schematic diagram of the integrated source driver 20, and thus elements with similar functions and signals are denoted by the same symbol. The reference voltage generating circuit 202 directly generates positive adjustable voltage ranges $PAVR_1$-$PAVR_m$, negative adjustable voltage ranges $NAVR_1$-$NAVR_m$ for the corresponding digital to analog converters $PDAC_1$-$PDAC_m$, $NDAC_1$-$NDAC_m$ within the supply voltage VS and the ground level GND by resistor division voltages or other methods, such that the digital to analog converters $PDAC_1$-$PDAC_m$, $NDAC_1$-$NDAC_m$ select and output the corresponding internal reference voltages $VPREF_1$-$VPREF_m$, $VNREF_1$-$VNREF_m$ within the adjustable voltage ranges $PAVR_1$-$PAVR_m$, $NAVR_1$-$NAVR_m$ according to the received control signal CON, respectively (i.e. each of the internal reference voltages $VPREF_1$-$VPREF_m$, $VNREF_1$-$VNREF_m$ is corresponding to a specific voltage level corresponding to a specific digital code of the control signal CON). Then the voltage buffers $PVB_1$-$PVB_m$, $NVB_1$-$NVB_m$ stably output the internal reference voltages $VPREF_1$-$VPREF_m$, $VNREF_1$-$VNREF_m$ for a positive polarity gamma correction resistor 510 and a negative gamma correction resistor 512 of the source driving circuit 208 by feedback for following operations. The digital codes of the control signal CON for each of the digital to analog converters $PDAC_1$-$PDAC_m$, $NDAC_1$-$NDAC_m$ to generate the respective internal reference voltage $VPREF_1$-$VPREF_m$, $VNREF_1$-$VNREF_m$, are not all the same (e.g. the internal reference voltage $VPREF_1$ can be at the upper bound of the adjustable voltage range $PAVR_1$ and the internal reference voltage $VPREF_2$ can be at the lower bound of the adjustable voltage range $PAVR_2$). Under this structure, the present invention can adjust bit numbers of the digital to analog converters $PDAC_1$-$PDAC_m$, $NDAC_1$-$NDAC_m$, so as to save the hardware cost for the same voltage adjustment resolution or increase the voltage adjustment resolution for the same hardware cost.

Noticeably, the spirit of the present invention is to minimize the corresponding adjustable voltage ranges $PAVR_1$-$PAVR_m$, $NAVR_1$-$NAVR_m$ according to practical applications when generating the internal reference voltages $VPREF_1$-$VPREF_m$, $VNREF_1$-$VNREF_m$ via integration, to achieve higher adjustable resolution for the same hardware cost, or require less hardware for the same resolution. Those skilled in the art can make modifications or alterations accordingly. For example, the reference voltage generating circuit 202 in the embodiment shown in FIG. 5 directly generates adjustable voltage ranges $PAVR_1$-$PAVR_m$, $NAVR_1$-$NAVR_m$ within the supply voltage VS and the ground level GND by resistor division voltages or other methods. However, the reference voltage generating circuit 202 in other embodiments may receive external reference voltages and generate the adjustable voltage ranges $PAVR_1$-$PAVR_m$, $NAVR_1$-$NAVR_m$ accordingly.

Figure 6:
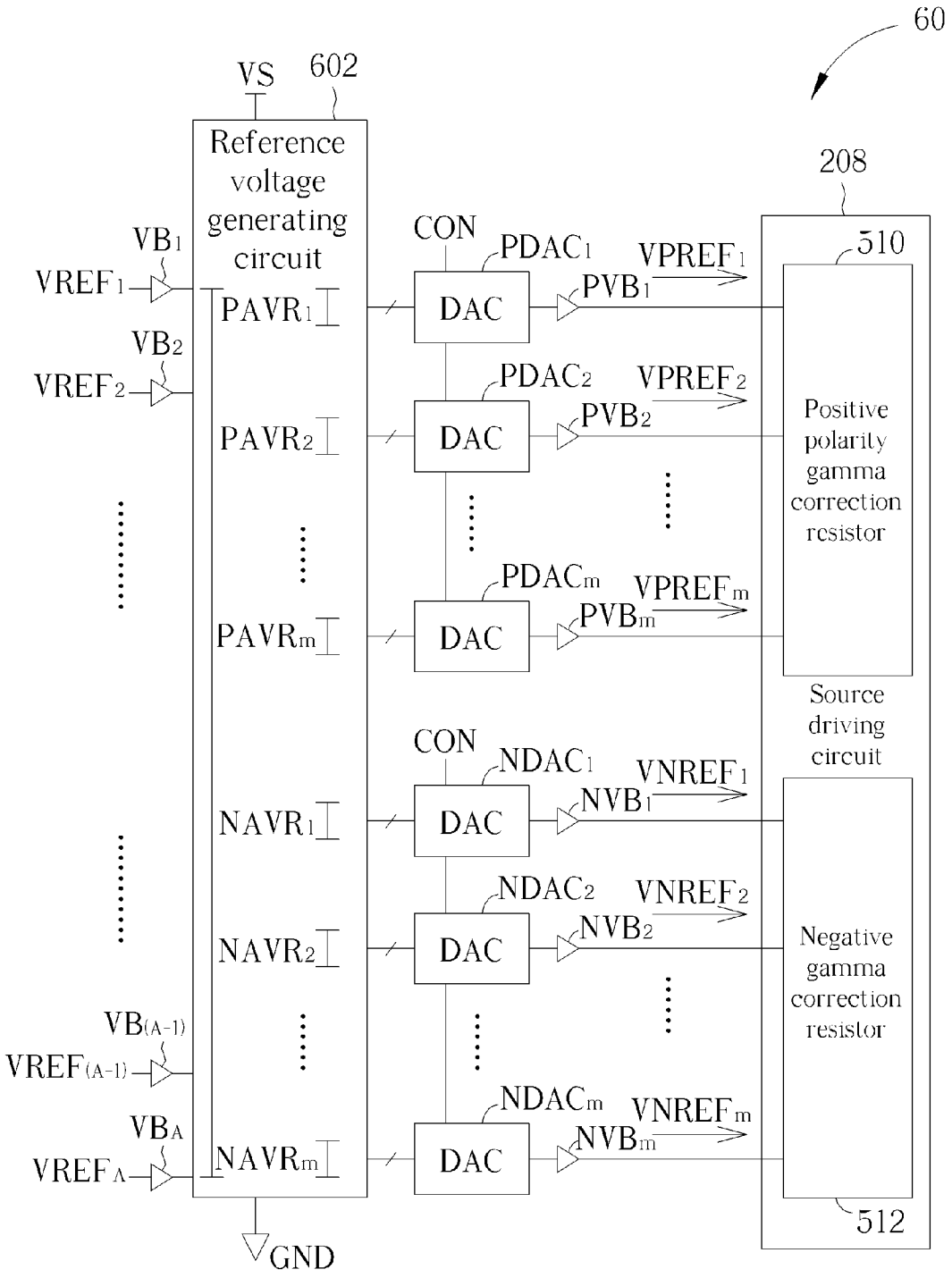
FIG. 6 is a schematic diagram of another integrated source driver according to an embodiment of the present invention.

For example, please refer to FIG. 6, which is a schematic diagram of another integrated source driver 60 according to an embodiment of the present invention. As shown in FIG. 6, the integrated source driver 60 and the integrated source driver 50 shown in FIG. 5 are the same in parts, and thus elements and signals with similar functions are denoted by the same symbol. Main differences between the integrated source driver 60 and the integrated source driver 50 are that a reference voltage generating circuit 602 included in the integrated source driver 60 further receives external reference voltages $VREF_1$-$VREF_A$, and provides at least one of the adjustable voltage ranges $PAVR_1$-$PAVR_m$, $NAVR_1$-$NAVR_m$ within the supply voltage VS and the ground level GND according to the external reference voltage $VREF_1$-$VREF_A$.

In such a condition, compared to the reference voltage generating circuit 202 shown in FIG. 5 which directly generates the adjustable voltage ranges $PAVR_1$-$PAVR_m$, $NAVR_1$-$NAVR_m$ within the supply voltage VS and the ground level GND and thus may cause the adjustable voltage ranges $PAVR_1$-$PAVR_m$, $NAVR_1$-$NAVR_m$ to deviate from an ideal value when the supply voltage VS is unstable, the reference voltage generating circuit 602 shown in FIG. 6 receives stable external reference voltages $VREF_1$-$VREF_A$, which are provided and buffered by the voltage buffers $VB_1$-$VB_A$, as reference voltage points. Therefore, the reference voltage points within the supply voltage VS and the ground level GND are stable, and are capable of generating stable adjustable voltage ranges $PAVR_1$-$PAVR_m$, $NAVR_1$-$NAVR_m$. Noticeably, the present invention generates the internal reference voltages $VPREF_1$-$VPREF_m$, $VNREF_1$-$VNREF_m$ via integration, to reduce the external reference voltage points, and hence saves the system cost and dynamically adjusts the reference voltages. Therefore, the number of the external reference voltages $VREF_1$-$VREF_A$ received from an external system in FIG. 6 should be less than that of the required internal reference voltages $VPREF_1$-$VPREF_m$, $VNREF_1$-$VNREF_m$ (i.e. $A<2m$), to achieve the advantages of integration.

Figure 7:
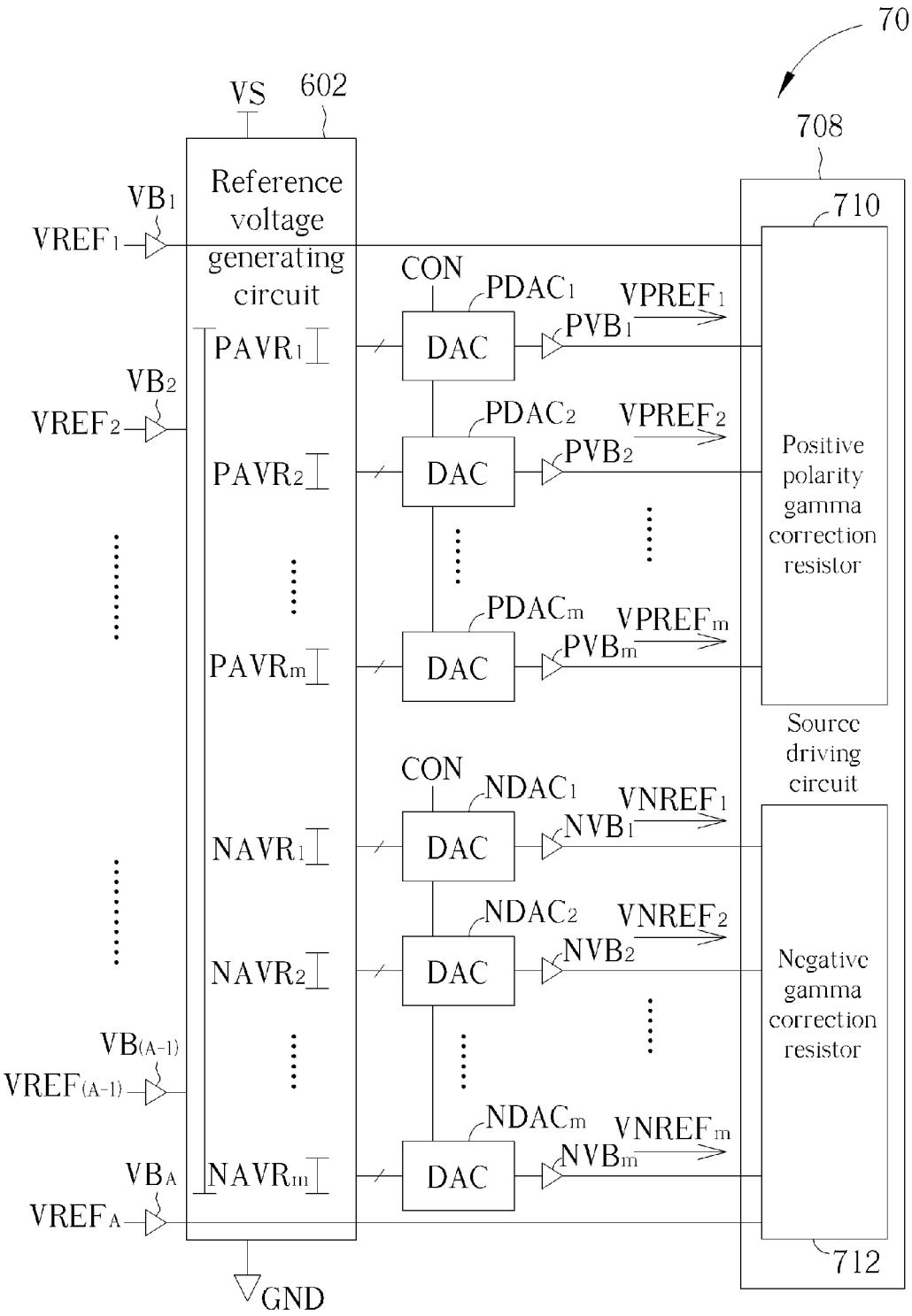
FIG. 7 is a schematic diagram of a further integrated source driver according to an embodiment of the present invention.

Besides, please refer to FIG. 7, which is a schematic diagram of a further integrated source driver 70 according to an embodiment of the present invention. As shown in FIG. 7, the integrated source driver 70 and the integrated source driver 60 are the same in parts, and thus elements and signals with the similar functions are denoted by the same symbol. The main difference between the integrated source driver 70 and the integrated source driver 60 is that a source driving circuit 708 included in the integrated source driver 70 receives external reference voltage $VREF_1$, $VREF_A$ by a positive polarity gamma correction resistor 710 and a negative polarity gamma correction resistor 712, and then performs driving according to internal reference voltages $VPREF_2$-$VPREF_m$, $VNREF_1$-$VNREF_{m-1}$ and external reference voltages $VREF_1$, $VREF_A$. In such a condition, since external reference voltages $VREF_1$, $VREF_A$ can also be adjusted within specific voltage ranges, the source driving circuit 708 can directly receive the external reference voltage $VREF_1$, $VREF_A$ from an external system, to replace the internal reference voltage $VPREF_1$, $VNREF_m$ generated by the internal system shown in FIG. 6, so as to save a hardware cost of corresponding digital to analog converters $PDAC_1$, $NDAC_m$ and positive voltage buffers $PVB_1$, $NVB_m$.

Figure 8:
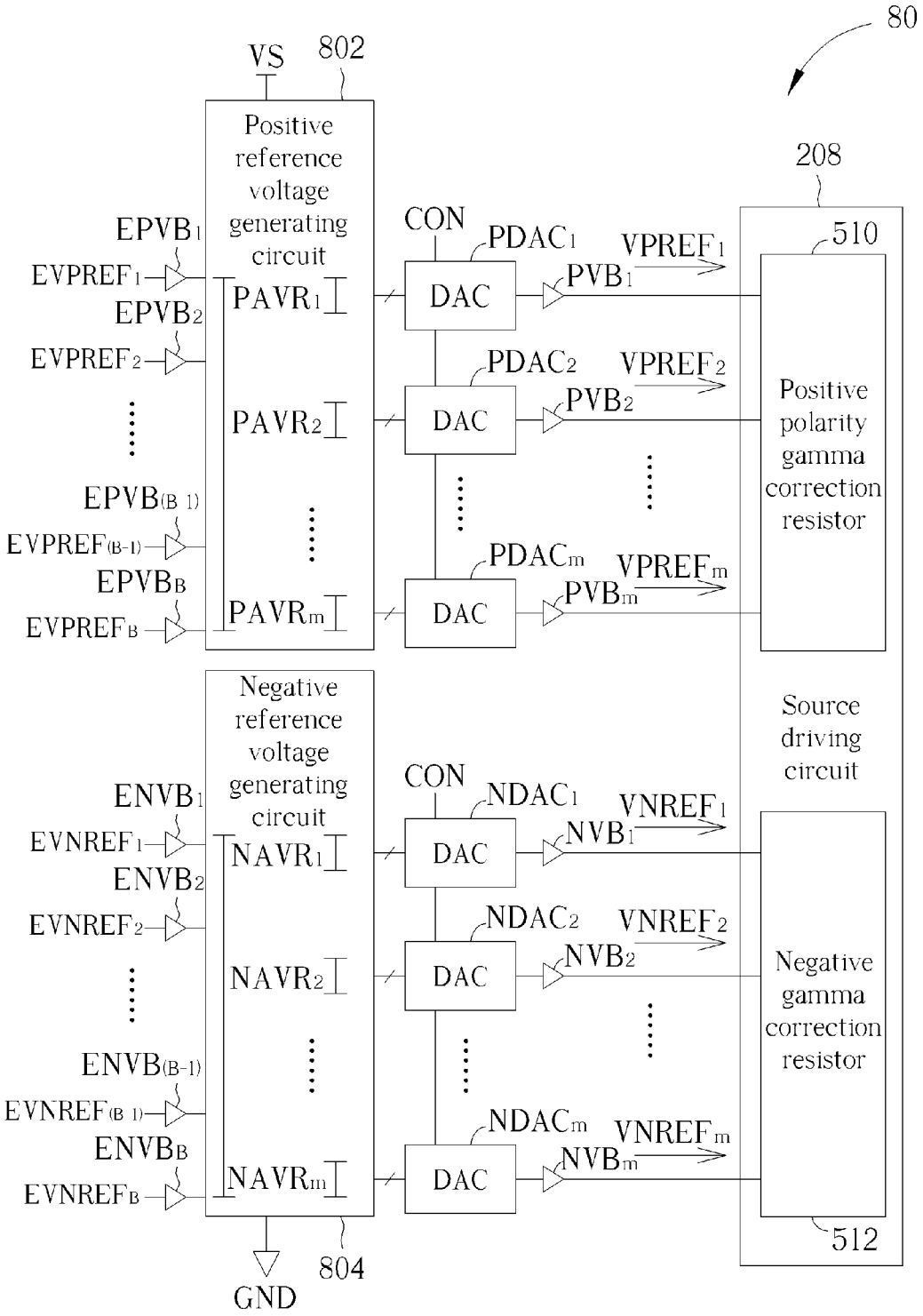
FIG. 8 is a schematic diagram of a further integrated source driver according to an embodiment of the present invention.

Moreover, please refer to FIG. 8, which is a schematic diagram of a further integrated source driver 80 according to an embodiment of the present invention. As shown in FIG. 8, the integrated source driver 80 and integrated source driver 60 are the same in parts, and thus elements and signals with similar functions are denoted by the same symbol. The main difference between the integrated source driver 80 and the integrated source driver 60 is that the integrated source driver 80 comprises a positive reference voltage generating circuit 802 and a negative reference voltage generating circuit 804 (can be integrated into a reference voltage generating circuit), for receiving external reference voltages $EVPREF_1$-$EVPREF_B$, $EVNREF_1$-$EVNREF_B$, respectively, and providing at least one of adjust voltage range $PAVR_1$-$PAVR_m$, $NAVR_1$-$NAVR_m$ within the supply voltage VS and the ground level GND according to the external reference voltage $EVPREF_1$-$EVPREF_B$, $EVNREF_1$-$EVNREF_B$.

The positive reference voltage generating circuit 802 and the negative reference voltage generating circuit 804 in the embodiment shown in FIG. 8 receive the stable external reference voltages $EVPREF_1$-$EVPREF_B$, $EVNREF_1$-$EVNREF_B$ provided and buffered by voltage buffers $EPVB_1$-$EPVB_B$, $ENVB_1$-$ENVB_B$ as reference voltage points. Therefore, the reference voltage points are stable within the supply voltage VS and the ground level GND, and are capable of generating stable adjustable voltage ranges $PAVR_1$-$PAVR_m$, $NAVR_1$-$NAVR_m$, wherein the external reference voltage $EVPREF_1$ is a maximum positive reference voltage, the external reference voltage $EVPREF_B$ is a minimum positive reference voltage, the external reference voltage $EVNREF_1$ is a maximum negative reference voltage and external reference voltage $EVNREF_B$ is a minimum negative reference voltage.

In such a condition, since the external reference voltage $EVPREF_1$, $EVPREF_B$, $EVNREF_1$, $EVNREF_B$ are stable reference voltage points, the positive reference voltage range and the negative reference voltage range of the positive reference voltage generating circuit 802 and the negative reference voltage generating circuit 804 can be clearly defined, to avoid accumulated errors from resistor division voltage and increase the accuracy of generating the internal reference voltages $VPREF_1$-$VPREF_m$, $VNREF_1$-$VNREF_m$. Noticeably, the present invention generates the internal reference voltages $VPREF_1$-$VPREF_m$, $VNREF_1$-$VNREF_m$ via integration, to reduce the external reference voltage points, and thus saves the system cost and dynamically adjusts the reference voltages. Therefore, the number of the external reference voltage $EVPREF_1$-$EVPREF_B$, $EVNREF_1$-$EVNREF_B$ received from an external system in FIG. 8 should be less than that of the required internal reference voltages $VPREF_1$-$VPREF_m$, $VNREF_1$-$VNREF_m$ (i.e. 2B<2m), to achieve the advantages of integration.

Figure 9:
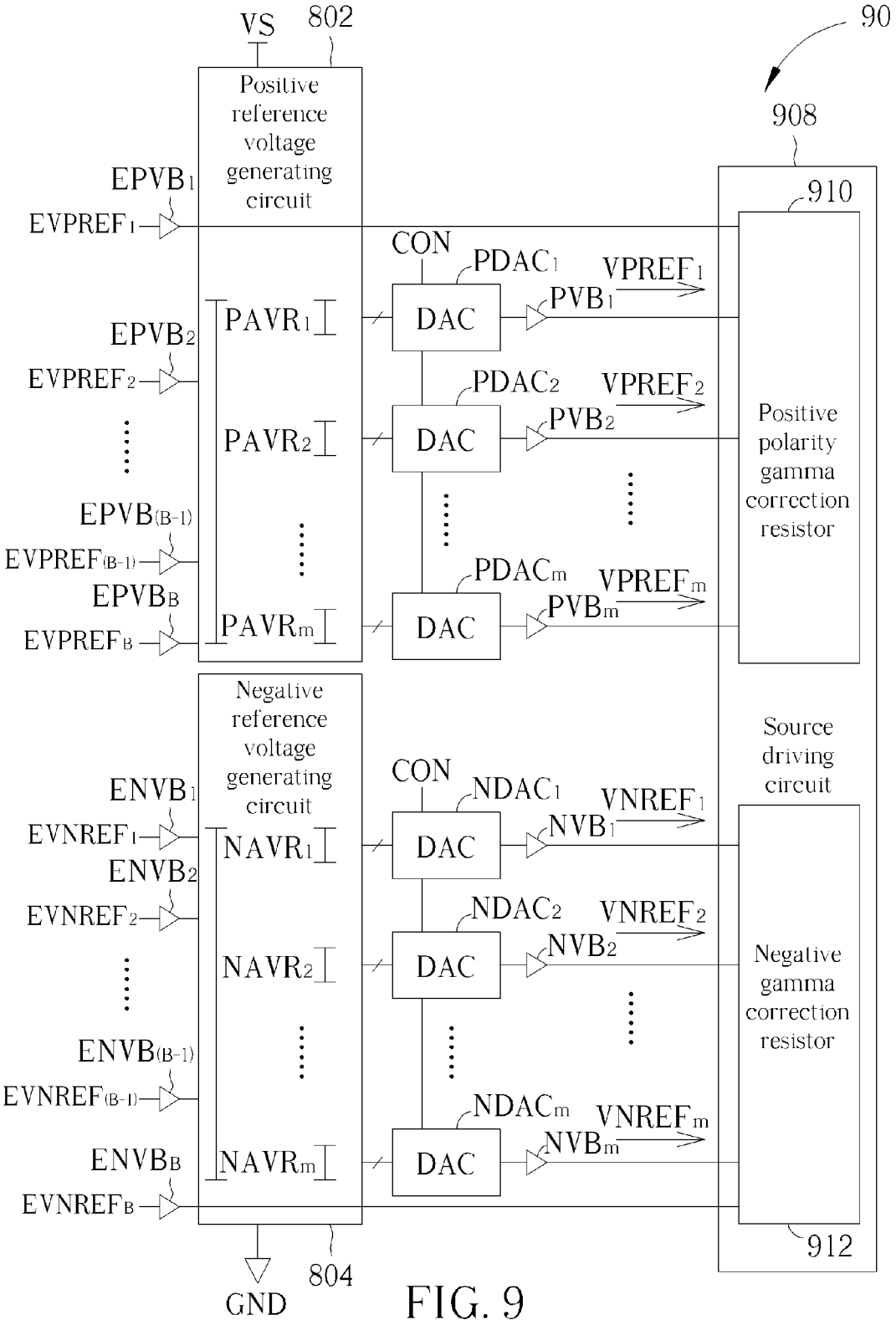
FIG. 9 is a schematic diagram of a further integrated source driver according to an embodiment of the present invention.

In addition, please refer to FIG. 9, which is a schematic diagram of a further integrated source driver 90 according to an embodiment of the present invention. As shown in FIG. 9, the integrated source driver 90 and the integrated source driver 80 are the same in parts, and thus elements and signals with similar functions are denoted by the same symbol. The main difference between the integrated source driver 90 and the integrated source driver 80 is that a source driving circuit 908 included in the integrated source driver 90 receives external reference voltage $EVPREF_1$, $EVNREF_B$ by a positive polarity gamma correction resistor 910 and a negative polarity gamma correction resistor 912, and then performs driving according to internal reference voltages $VPREF_2$-$VPREF_m$, $VNREF_1$-$VNREF_{m-1}$ and the external reference voltages $EVPREF_1$, $EVNREF_B$. The external reference voltage $EVPREF_1$ is a maximum positive reference voltage and the external reference voltage $EVNREF_B$ is a minimum negative reference voltage. In such a condition, since the external reference voltage $EVPREF_1$, $EVNREF_B$ is also adjustable within a specific voltage range thereof, the source driving circuit 908 is capable of directly receiving the external reference voltages $EVPREF_1$, $EVNREF_B$ from an external system, to replace the internal reference voltages $VPREF_1$, $VNREF_m$ generated inside, so as to save the hardware cost of the corresponding digital to analog converters $PDAC_1$, $NDAC_m$ and positive voltage buffers $PVB_1$, $NVB_m$.

Noticeably, the reference voltage generating circuit and the source driving circuit in the above embodiment receive the external reference voltages with specific voltage levels and specific numbers, respectively, for having stable reference voltage points and saving hardware cost. However, the reference voltage generating circuit and the source driving circuit in other embodiments may receive external reference voltages with other voltage levels and other numbers, respectively, according to practical requirements, and still have stable reference voltage points and save hardware cost. Besides, FIGS. 5 to 9 are embodiments of a single integrated source driver. However, a plurality of source drivers are required to drive pixels of corresponding data lines, respectively, in a panel application of a general liquid crystal display device. Therefore, a plurality of integrated source drivers may be utilized in other embodiments for the panel application of the liquid crystal display device.

Figure 10:
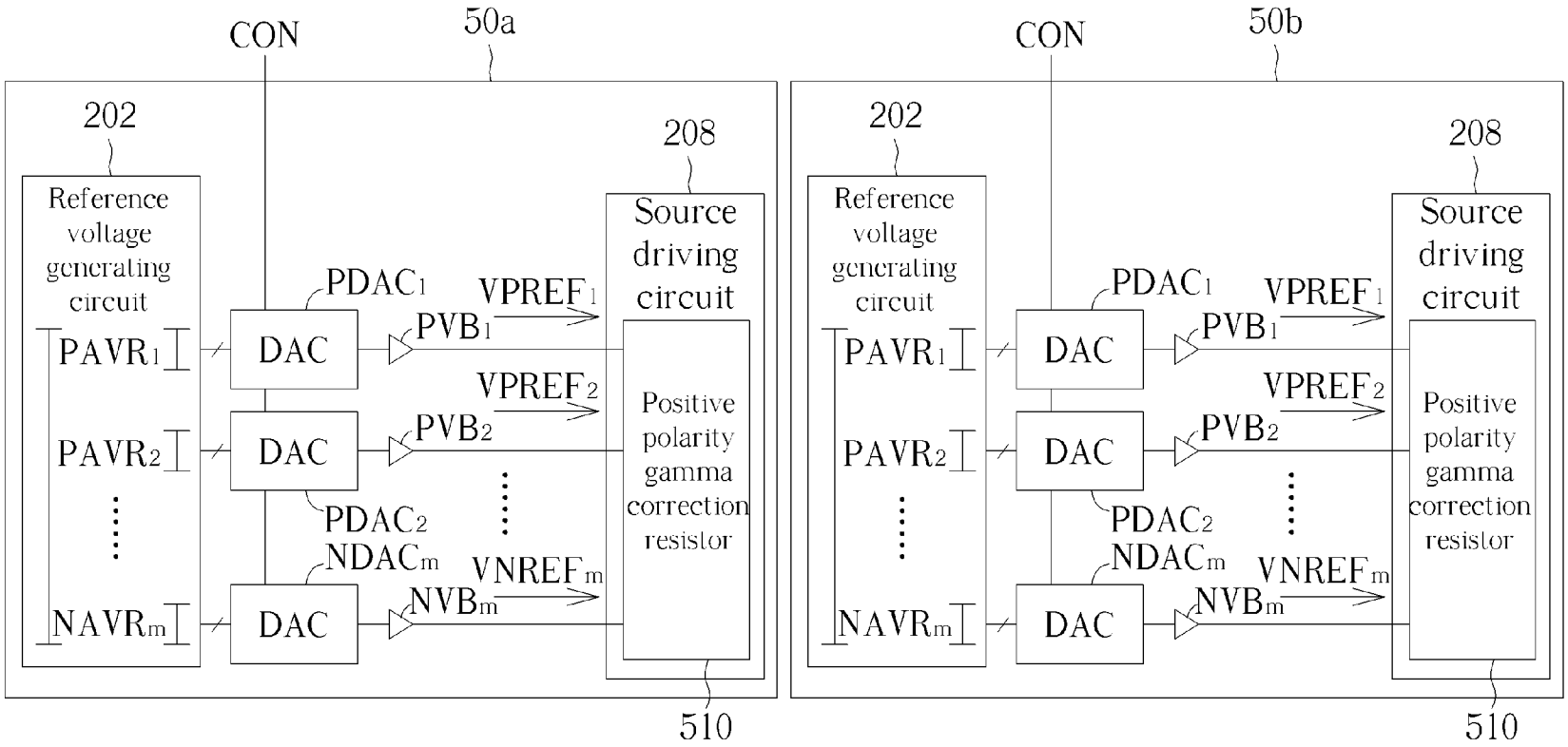
FIG. 10 is a schematic diagram of two integrated source drivers in a panel application according to an embodiment of the present invention.

For example, please refer to FIG. 10, which is a schematic diagram of integrated source drivers 50*a*, 50*b* in a panel application according to an embodiment of the present invention. The integrated source drivers 50*a*, 50*b* and the integrated source driver 50 are completely the same, and thus denotation is omitted for simplicity. In such a condition, the integrated source drivers 50*a*, 50*b* directly generate internal reference voltages within the supply voltage and the ground level for driving pixels of corresponding data lines in the plurality of data lines, respectively. Therefore, the external system only needs to provide the control signal CON and no need for providing external reference voltages.

Figure 11:
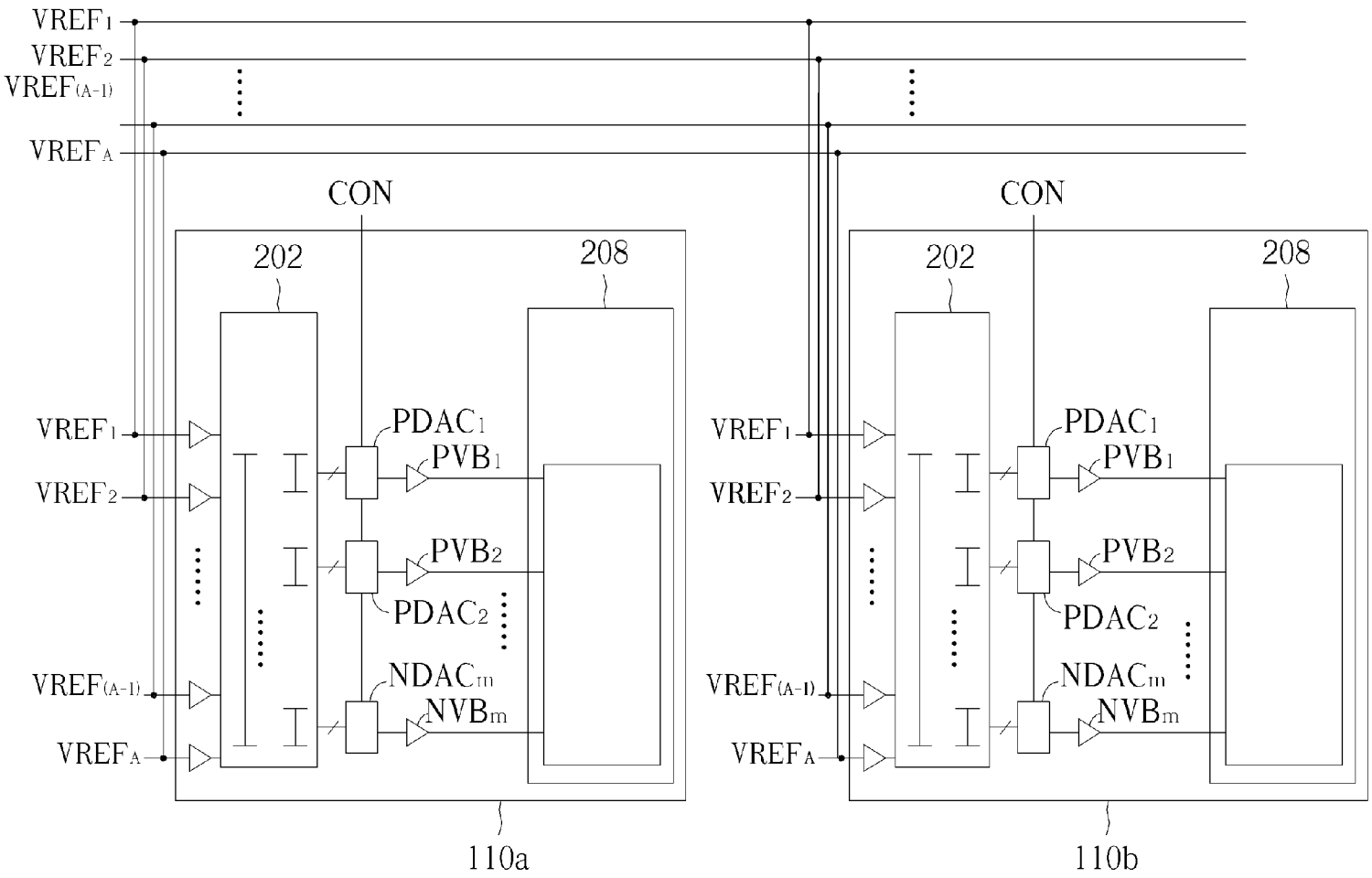
FIG. 11 is a schematic diagram of another two integrated source drivers in a panel application according to an embodiment of the present invention.

Besides, please refer to FIG. 11, which is a schematic diagram of integrated source drivers 110*a*, 110*b* in a panel application according to an embodiment of the present invention. The integrated source driver 110*a*, 110*b* can be realized by at least one of the integrated source driver 60, 70, 80, 90, and thus denotation is omitted for simplicity. In such a condition, the integrated source driver 110*a*, 110*b* receive stable external reference voltages $VREF_1$-$VREF_A$ as the reference voltage points, and then generate internal reference voltages to drive pixels of corresponding data lines. Therefore, the external system may provide the external reference voltages $VREF_1$-$VREF_A$ for both the integrated source driver 110*a*, 110*b*.

Figure 12:
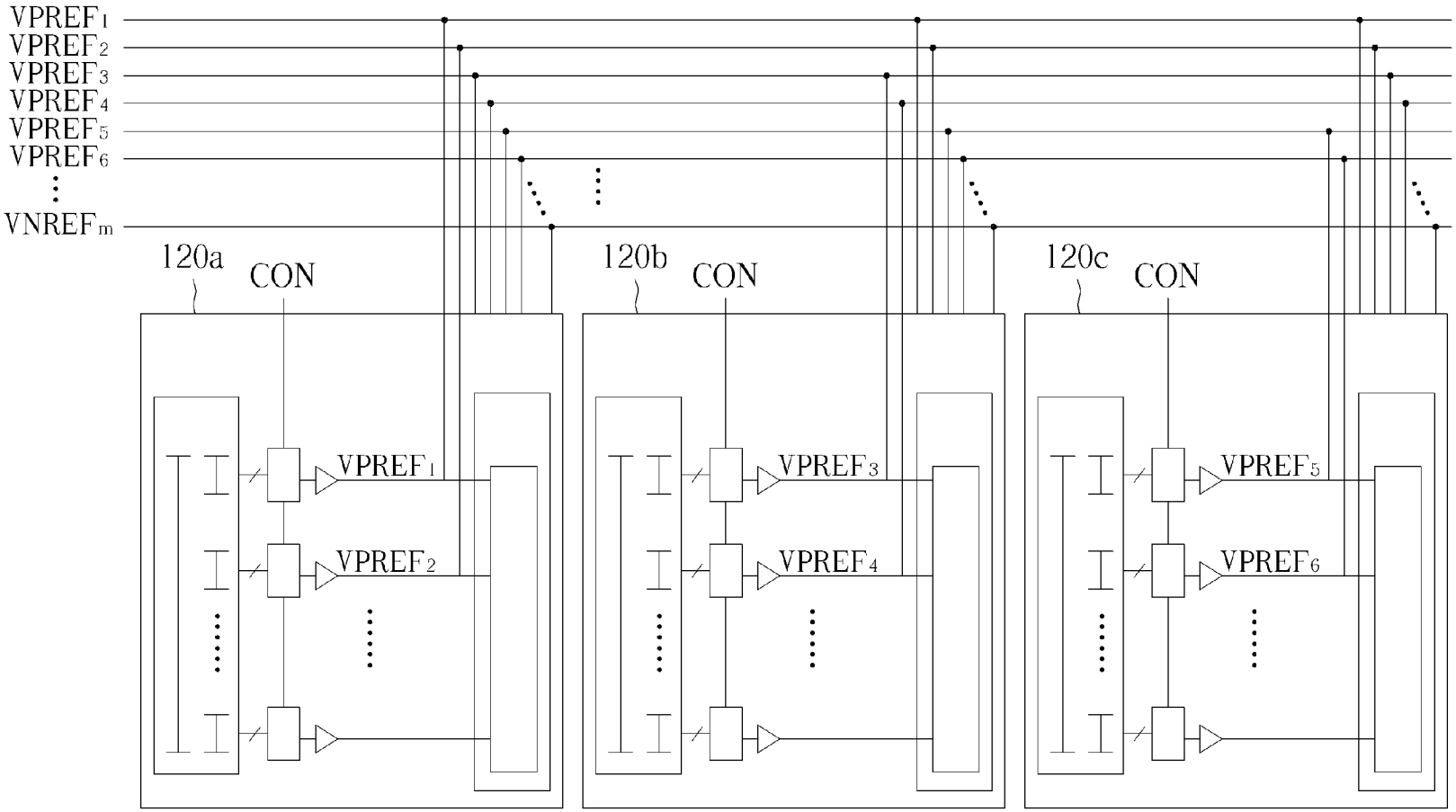
FIG. 12 a schematic diagram of three integrated source drivers in a panel application according to an embodiment of the present invention.

Moreover, please refer to FIG. 12, which is a schematic diagram of integrated source drivers 120*a*, 120*b*, 120*c* in a panel application according to an embodiment of the present invention. The integrated source drivers 120*a*, 120*b*, 120*c* are partially the same with at least one of the integrated source drivers 60, 70, 80, 90, and thus denotation is omitted for simplicity. The main difference between the integrated source drivers 120*a*, 120*b*, 120*c* and at least one of the integrated source driver 60, 70, 80, 90 is that the integrated source driver 120*a* generates internal reference voltages $VPREF_1$-$VPREF_2$ and provides internal reference voltages $VPREF_1$-$VPREF_2$ for the integrated source drivers 120*b*, 120*c* for driving. In such a situation, the integrated source drivers 120*b*, 120*c* directly receive the internal reference voltages $VPREF_1$-$VPREF_2$ generated by the integrated source driver 120*a*, and thus save hardware cost of corresponding digital to analog converters and positive voltage buffers. By the same token, the integrated source driver 120*b* provides internal reference voltages $VPREF_3$-$VPREF_4$ for the integrated source drivers 120*a*, 120*c* so as to save hardware cost of corresponding digital to analog converters and positive voltage buffers. The integrated source driver 120*c* provides internal reference voltages $VPREF_5$-$VPREF_6$ for the integrated source drivers 120*a*, 120*b* so as to save hardware cost of corresponding digital to analog converters and positive voltage buffers. As a result, since internal reference voltages generated by control signal CON inside an integrated source driver are not limited only for the integrated source stage driver itself, each integrated source driver may generate partial internal reference voltages for other integrated source drivers, respectively, and internal reference voltages generated by other integrated source drivers may be used as external reference voltages shown in FIGS. 6 to 9. Reference voltage points are therefore reduced or not required from external systems.

Figure 13:
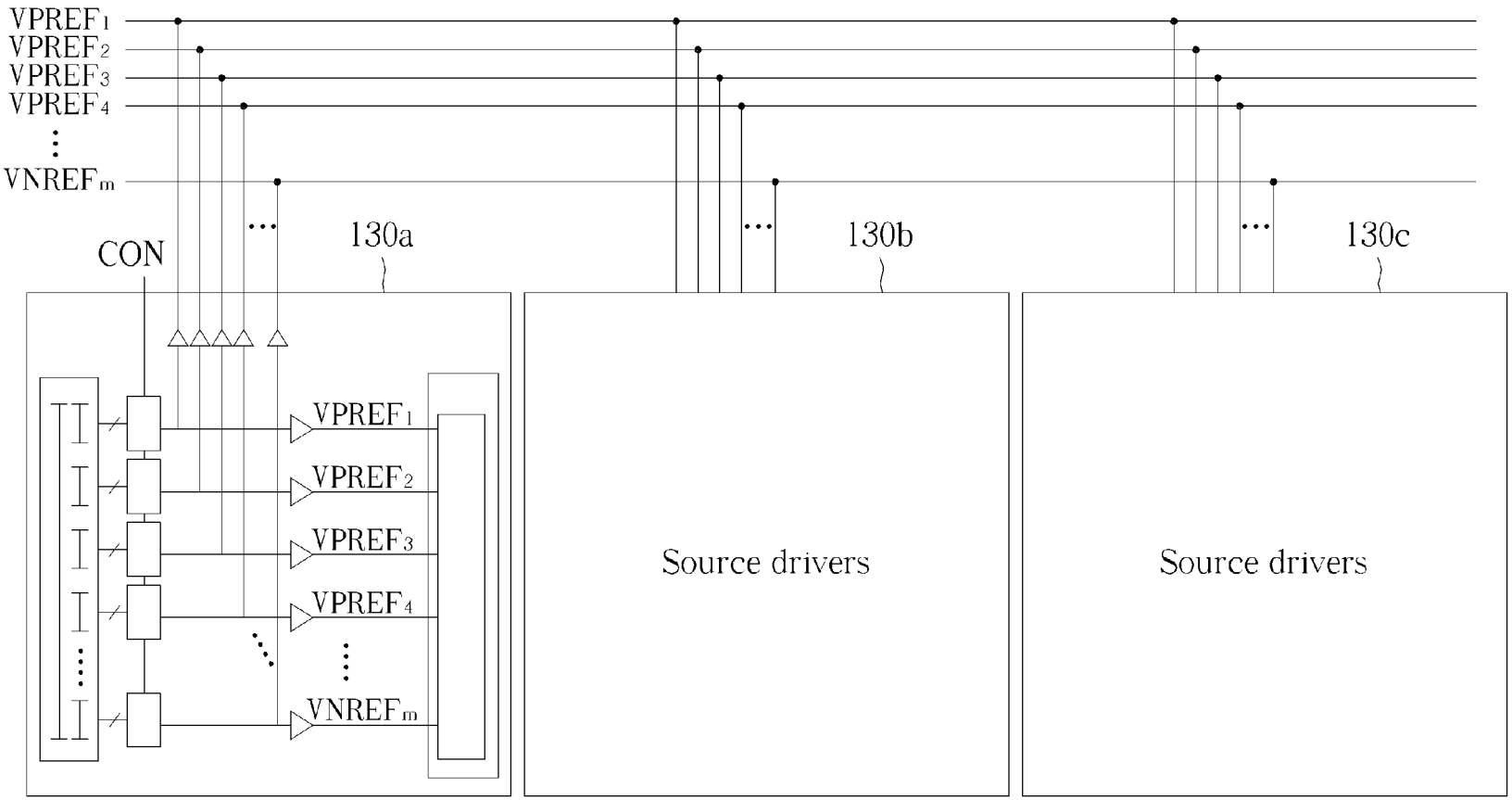
FIG. 13 a schematic diagram of an integrated source driver and two source drivers in a panel application according to an embodiment of the present invention.

Furthermore, please refer to FIG. 13, which is a schematic diagram of an integrated source driver 130*a* and source drivers 130*b*, 130*c* in a panel application according to an embodiment of the present invention. The integrated source driver 130*a* and the integrated source driver 50*a* are the same in parts, and thus denotation is omitted for simplicity. The main difference between the integrated source driver 130*a* and the integrated source driver 50 is that the integrated source driver 130*a* provides all internal reference voltages $VPREF_1$-$VPREF_m$, $VNREF_1$-$VNREF_m$ to the source drivers 130*b*, 130*c* for driving after generating internal reference voltage $VPREF_1$-$VPREF_m$, $VNREF_1$-$VNREF_m$. In such a situation, the source drivers 130*b*, 130*c* directly receive the internal reference voltage $VPREF_1$-$VPREF_m$, $VNREF_1$-$VNREF_m$ generated all by the integrated source driver 130*a*, and thus completely save hardware cost of corresponding digital to analog converters and positive voltage buffers (i.e. the integrated source drivers 130*b*, 130*c* are similar to the conventional source driver 10).

Figure 14:
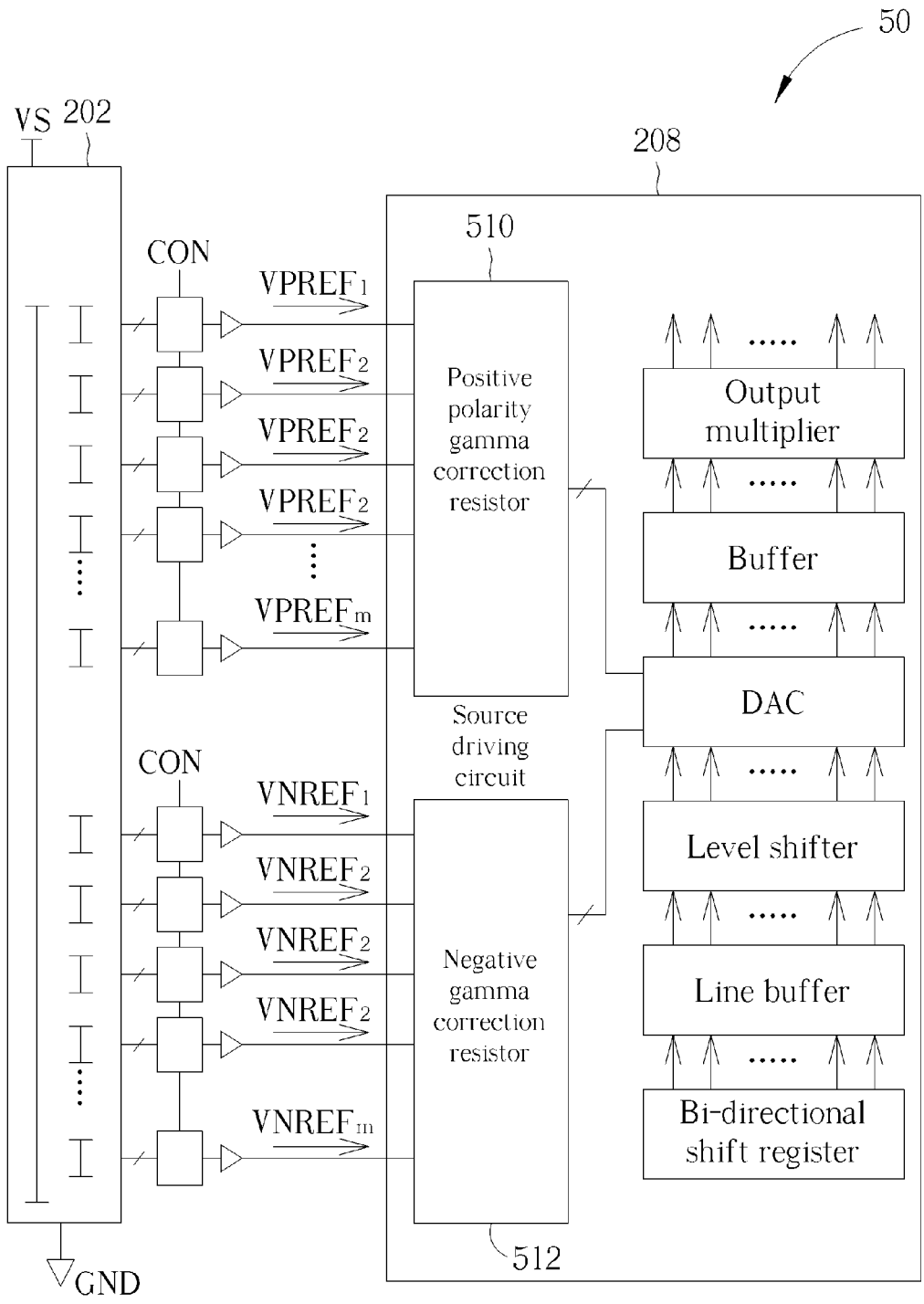
FIG. 14 is a detailed schematic diagram of the integrated source driver shown in FIG. 5.

Noticeably, the integrated source driver 130*a* in the above embodiment integrates external circuits that generate the reference voltages, and generates the internal reference voltages to drive source driving circuit. The circuits that are integrated are different from those that perform driving based on reference voltages in the original source driver. In detail, please refer to FIG. 14, which is a detailed schematic diagram of the integrated source driver 50 shown in FIG. 5. As shown in FIG. 14, the positive polarity gamma correction resistor 510 and the negative polarity gamma correction resistor 512 receive internal reference voltages $VPREF_1$-$VPREF_m$, $VNREF_1$-$VNREF_m$ and then deliver to the voltages to the digital to analog converter in the source driving circuit 208 for selecting (the digital to analog converter herein is not the same as the digital to analog converters $PDAC_1$-$PDAC_m$, $NDAC_1$-$NDAC_m$). Therefore, a bi-directional shift register, a line buffer, a level shifter, a digital to analog converter, a buffer, and an output multiplier are utilized in the source driving circuit 208 to output a correct voltage level for driving. This part is well-known for those skilled in the art, and hence is not narrated hereinafter.

In the prior art, if the conventional external reference voltage generator 12 and the conventional source driver 10 are directly integrated into an integrated source driver, and if adjustable ranges of reference voltages are still the same with the rail-to-rail adjustable ranges of the conventional external reference voltage generator 12 while maintaining high resolution, hardware cost is quite large because the source driver 10 requires a large amount of reference voltages. In comparison, the present invention minimizes corresponding adjustable voltage ranges $PAVR_1$-$PAVR_m$, $NAVR_1$-$NAVR_m$ according to practical applications when integrating to generate the internal reference voltages $VPREF_1$-$VPREF_m$, $VNREF_1$-$VNREF_m$, to achieve higher resolution for the same hardware cost, or require less hardware for the same resolution.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An integrated source driver for a liquid crystal display device, comprising:

a reference voltage generating circuit, for providing a plurality of adjustable voltage ranges within a supply voltage and a ground level; and a reference voltage selecting circuit, comprising a plurality of digital to analog converters (DACs), for selecting and generating a plurality of internal reference voltages from the plurality of adjustable voltage ranges according to a control signal, respectively;

wherein the plurality of adjustable voltage ranges decrease progressively;

wherein the reference voltage generating circuit receives at least one first external reference voltage;

wherein a plurality of second voltage buffers buffer the at least one first external reference voltage.

2. The integrated source driver of claim 1 further comprising:

a plurality of first voltage buffers, coupled to the plurality of digital to analog converters, respectively, for buffering the plurality of internal reference voltages; and a source driving circuit, for driving according to the plurality of internal reference voltages received from the plurality of first voltage buffers.

3. The integrated source driver of claim 1, wherein the reference voltage generating circuit provides at least one of the plurality of adjustable voltage ranges within the supply voltage and the ground level according to the at least one first external reference voltage.

4. The integrated source driver of claim 3, wherein a number of the at least one first external reference voltage is less than a number of the plurality of internal reference voltages.

5. The integrated source driver of claim 3, wherein the at least one first external reference voltage comprises a maximum positive reference voltage, a minimum positive reference voltage, a maximum negative reference voltage and a minimum negative reference voltage.

6. The integrated source driver of claim 1 further comprising a source driving circuit, for receiving at least one second external reference voltage, and driving according to the plurality of internal reference voltages and the at least one second external reference voltage.

7. The integrated source driver of claim 6, wherein the at least one second external reference voltage comprises a maximum positive reference voltage and a minimum negative reference voltage.

8. A liquid crystal display device, comprising:

a plurality of data lines; and a plurality of integrated source drivers, for driving pixels of corresponding data lines in the plurality of data lines, respectively, wherein a first integrated source driver in the plurality of integrated source drivers comprises:

a reference voltage generating circuit, for providing a plurality of adjustable voltage ranges within a power supply voltage and a ground level; and a reference voltage selecting circuit, comprising a plurality of digital to analog converters (DACs), for selecting and generating a plurality of first internal reference voltages from the plurality of adjustable voltage ranges according to a control signal, respectively;

wherein the plurality of adjustable voltage ranges decrease progressively;

wherein the first integrated source driver provides the plurality of first internal reference voltages for a second integrated source driver in the plurality of integrated source drivers to perform driving.

9. The liquid crystal display device of claim 8, wherein the first integrated source driver further comprising:

a plurality of first voltage buffers, coupled to the plurality of digital to analog converters, respectively, for buffering the plurality of internal reference voltages; and a source driving circuit, for driving according to the plurality of internal reference voltages received from the plurality of first voltage buffers.

10. The liquid crystal display device of claim 8, wherein the reference voltage generating circuit receives at least one first external reference voltage, and provides at least one of the plurality of adjustable voltage ranges within the supply voltage and the ground level according to the at least one first external reference voltage.

11. The liquid crystal display device of claim 10, wherein a plurality of second voltage buffers buffer the at least one first external reference voltage.

12. The liquid crystal display device of claim 10, wherein a number of the at least one first external reference voltage is less than a number of the plurality of internal reference voltages.

13. The liquid crystal display device of claim 8, wherein the first integrated source driver further comprising a source driving circuit, for receiving at least one second external reference voltage, and driving according to the plurality of internal reference voltages and the at least one second external reference voltage.

14. The liquid crystal display device of claim 13, wherein the at least one second external reference voltage comprises a maximum positive reference voltage and a minimum negative reference voltage.

15. The liquid crystal display device of claim 10, wherein the at least one first external reference voltage comprises a maximum positive reference voltage, a minimum positive reference voltage, a maximum negative reference voltage and a minimum negative reference voltage.

16. The liquid crystal display device of claim 8, wherein the first integrated source driver performs driving by receiving a plurality of second internal reference voltages from a second integrated source driver in the plurality of integrated source drivers.

* * * * *